United States Patent [19]

André et al.

[11] Patent Number: 4,864,792

[45] Date of Patent: Sep. 12, 1989

[54] PREFABRICATED MODULES, AND THE USE THEREOF IN THE BUILDING INDUSTRY

[75] Inventors: DeSchutter André, Laarne-Kalken, Belgium; Silvano Casalatina, Aosta, Italy

[73] Assignee: Sismo International, Belgium

[21] Appl. No.: 47,555

[22] Filed: Apr. 27, 1987

Related U.S. Application Data

[63] Continuation of Ser. No. 796,089, Nov. 8, 1985, abandoned.

[30] Foreign Application Priority Data

Nov. 8, 1984 [EP] European Pat. Off. ..... 84201602.4

[51] Int. Cl.[4] ..... E04B 2/40

[52] U.S. Cl. ..... 52/426; 52/309.12; 52/428; 52/454

[58] Field of Search ..... 52/309.12, 425, 426, 52/427, 428, 444, 454

[56] References Cited

U.S. PATENT DOCUMENTS

| | | | |
|---|---|---|---|
| 3,420,018 | 1/1969 | Fork . | |
| 3,679,529 | 7/1972 | Prusinski | 52/309.12 |
| 3,707,817 | 1/1973 | Schmitt et al. . | |
| 4,125,981 | 11/1978 | MacLeod | 52/309.12 |
| 4,336,676 | 6/1982 | Artze | 52/309.12 |
| 4,494,353 | 1/1985 | Lewis | 52/309.12 |
| 4,516,372 | 5/1985 | Grutsch | 52/309.12 |

FOREIGN PATENT DOCUMENTS

| | | | |
|---|---|---|---|
| 61100 | 9/1982 | European Pat. Off. . | |
| 117443 | 11/1986 | European Pat. Off. . | |
| 545450 | 2/1932 | Fed. Rep. of Germany . | |
| 1134813 | 8/1962 | Fed. Rep. of Germany | 52/427 |
| 2050171 | 3/1971 | France . | |
| 2090183 | 1/1972 | France . | |

*Primary Examiner*—Michael Safavi

*Attorney, Agent, or Firm*—Scully, Scott, Murphy & Presser

[57] ABSTRACT

There is described a prefabricated module comprising a three-dimensional armature formed by welded wires, and flat elements from light and/or heat-insulating material, retained on either side of the armature to form at least one continuous panel. One and the same module may be used either for bearing structures extending vertically, or for bearing structures extending horizontally, and having retaining means for the armatures.

11 Claims, 13 Drawing Sheets

PREFABRICATED MODULES, AND THE USE THEREOF IN THE BUILDING INDUSTRY

This application in a continuation, of application Ser. No. 796,089, filed Nov. 8, 1985, now abandoned.

BACKGROUND OF THE INVENTION

This invention relates to prefabricated modules, and particularly to modules used in the building industry, comprising an array of flat elements made from light material, and a plurality of nettings made from welded steel wires, which extend along a lengthwise direction of the module and which are welded to a series of cross-wise wires.

Such a prefabricated module, in which the nettings comprise lengthwise wires and spacing or brace wires that define sections in which the flat elements are arranged, is known. Said elements form two panels used as lost shuttering for casting reinforced concrete. The resistance of the concrete to tensile and shear stresses is insured by a reinforcement from steel wire embedded in the cast concrete.

A structure intended for building purposes obtained by means of the above-defined modules is strong, light, inexpensive, and, as a whole, can be quickly assembled.

The reinforcements in the empty spaces between two shuttering panels do not have a well-defined position. This requires the that the reinforcements be made with rather large safety factors.

The known module has moreover to be sized with a view to the particular use. More particularly, the elements made from light material and nettings used to support walls have a cross-section and a shape different from the being used for ceilings, beams and other horizontal structures. This requires that either the supplier or the building works store various types of nettings and light-material elements. Moreover, the horizontal structures, before casting, require the use of provisional shutterings for casting the concrete and stays, which increase the time needed to manufacture such structures.

SUMMARY OF THE INVENTION

An object of this invention is to provide light and relatively inexpensive prefabricated modules that may be quickly and easily used to form reinforcements for casting concrete, and which may also be used for bearing structures either with a vertical extension or with a horizontal extension. This object may be obtained with the prefabricated module according to the invention, which module is characterized by at least one pair of parallel positioning bars located along the lengthwise axis of the netting, and arranged between the wires from a stop lengthwise wire pair of the netting, with a view to retaining the reinforcements for the casting of reinforced concrete in pre-determined positions inside that space bounded by the light-material elements.

BRIEF DESCRIPTION OF THE DRAWINGS

Other features and advantages of the invention will stand out from the following description, given by way of non limitative example and with reference to the accompanying drawings, in which.

DETAILED DESCRIPTION OF THE PREFERRED EMBODIMENTS

Figure 1:
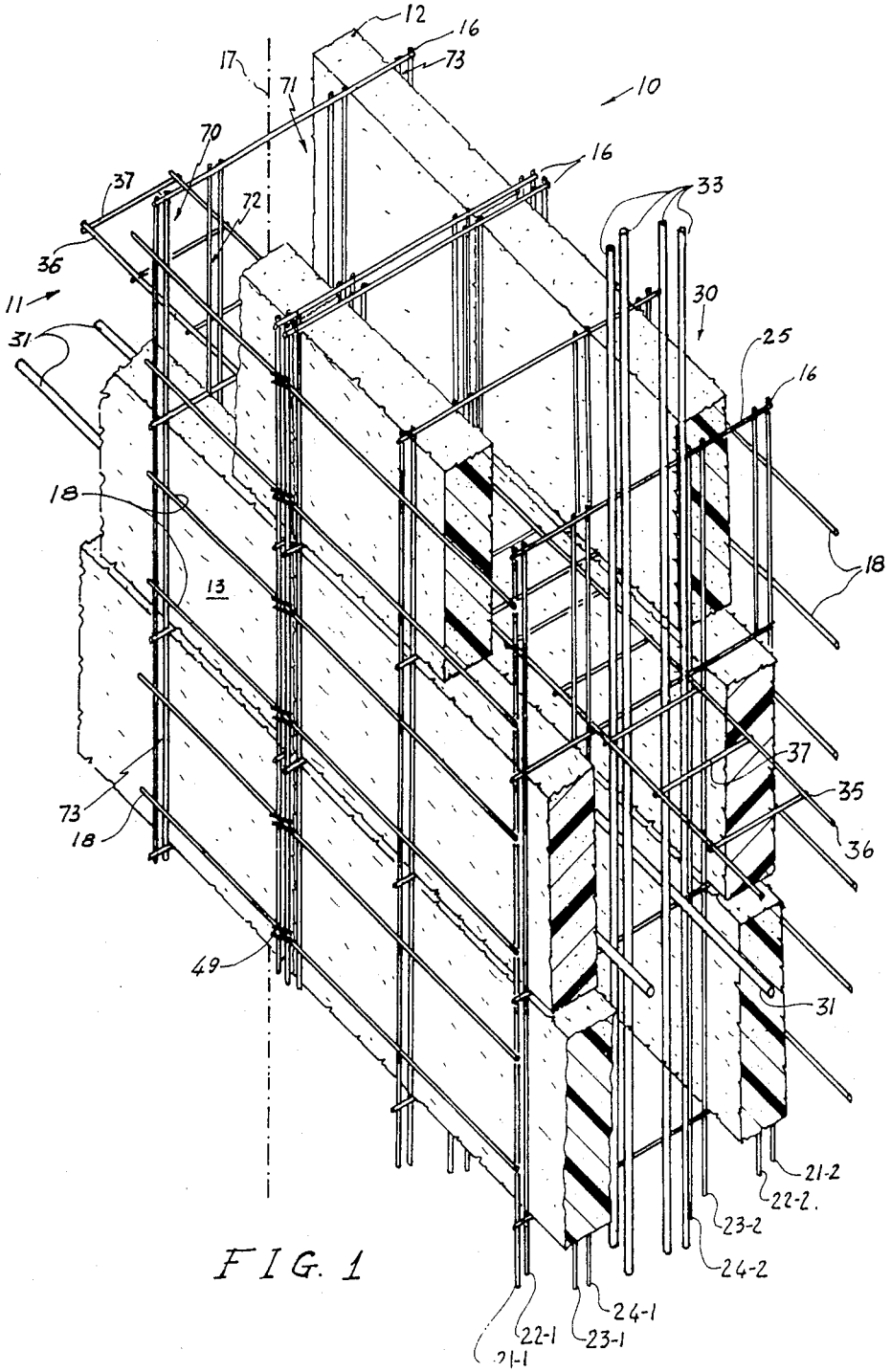
FIG. 1 is a diagrammatic perspective view of the module according to the invention.

The prefabricated module 10 (FIGS. 1, 2 and 3), comprises a three-dimensional armature 11 formed by welded wires, and flat elements 12 made from light and/or heat-insulating material, held on either side of said armature or reinforcement 11 in such a way as to form at least one continuous panel 13. A module 10 may be used either, as shown at 14, for bearing structures with vertical extension, or, as shown at 15, for bearing structures with horizontal extension.

The reinforcement or armature 11 comprises a series of identical nettings 16, each of which is substantially planar with an extended rectangular shape along a length wise axis 17. The nettings 16 are arranged facing one another, at right angle to the panel and said nettings are firmly held in their positions by two series of cross-wise wires 18. The length of said wires 18 is equal to the length L of said modules.

When module 10 is assembled in a building unit, the axes 17 of the nettings 16 lie either vertically in the structures 14 or horizontally in the structures 15. The cross-wise wires 18 on the other hand, lie horizontally and parallel with surface 13, which lies vertically in structure 14 and horizontally in structure 15.

Each netting 16 is made by welding a plurality of lengthwise wire pairs 21-1, 22-1, 23-1, 24-1, and 23-2, 24-2, 22-2, 21-2, which lie close together, parallel to axis 17, to spacing or bracing wires 25 which are uniformly spaced apart, at a right angle to the lengthwise wire pairs.

The two wires 21-1, 21-2 are the outermmost wires in the nettings 16, and the spacing therebetween determines the thickness TM of module 10; the two wires 24-1 and 24-2 are the innermost wires of the module 10, the wires 22-1 and 23-1 lie between wires 21-1 and 24-1, and the wires 22-2 and 23-2 lie between wires 21-2 and 24-2.

The complete armature 11 of modules 10 and 26 is obtained by welding the cross-wise wires 18 to the lengthwise wires 21-1, 22-1 in such a way that corresponding spacing wires 25 of different nettings 16 may be located in the same plane and at right angle to the planes of the lengthwise wires 21–24 and cross-wires 18. A particularly efficient method for making three-dimensional armatures comprising lengthwise wires, spacing or bracing wires and cross-wise wires is described in European Patent Application n° 84870056 filed on Apr. 4, 1984 by SISMO INTERNATIONAL p.v.b.a., holder of the present Application.

The prefabricated modules 10, 26 (FIGS. 1, 11*a* and 11*h*) normally make use of expanded polystyrene elements twelve having a thickness Tb and a width Wb (FIG. 2), independent of the specific use of the module itself. The length Lb of elements 12 is generally equal to the length L of module 10, 26. The lengthwise wires 21, 24 and 29 define, together with the spacing wires 25, single bearing locations 70 for one flat element 12, double bearing locations 71 for two flat elements 12, separation areas 72 inside the module, and two end areas 73 in outer portions of the module. The distance between axes of the locations 70–71 and areas 72 and 73 is equal in each module, independently of the thickness and the use of the module.

The distance, referred to Pl, between axes of the lengthwise wires 22-1 and 23-1 and of the wires 22-2 and 23-2 (FIG. 2) for the single bearing locations 70 is substantially equal to the thickness Tb of the elements 12, plus the wire diameter; while the distance between axes of the wires 24-1 and 24-2 for the double bearing locations (71) and of the wires 24-1 and 28-1, as well as of the wires 24-2 and 28-2 from the nettings 27, is substantially equal to twice the distance Pl.

Moreover the distance, referred to a Ps, between axes of the wires 21-1 and 22-1, 23-1 and 24-1 for the two end areas 73, and of the wires 21-2 and 22-2, 23-2 and 24-2, 28-1 and 28-2 in the separation areas 72 is equal to ¼ Pl.

Figure 2:
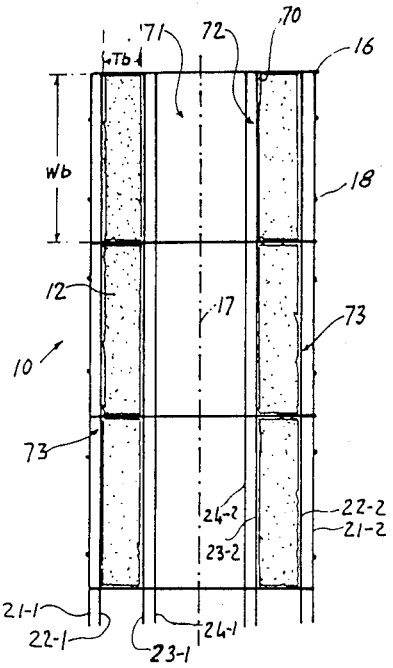
FIG. 2 shows a detail of the module shown in FIG. 1.

Assuming N to be the number of single bearing locations 70 and M is the number of double locations 71, each module will have a determined thickness equal to the sum of the distances between axes of the N locations, of the M locations 71, the N+(M−1) distances between the wires in the separation areas 72, and the distances between the wires in both end areas 73. By making use of a distance Ps equal to 1 cm, there are obtained standardized modules of 15, 20, 25, 30 and 35 cm, among which the modules of 20, 30 and 35 cm are shown in FIGS. 2, 11*b* and 11*g*. The other modules may be easily made by suitably combining the locations N and M and a cross-section of the spacing wires 25 from the 35 cm modules.

More particularly, there is very easily obtained by means of the nettings 27*g* (FIG. 11*g*), a 15 cm module, by cutting the spacing wires 25 adjacent to the separation area 72-1 to include only one row of single bearings (70) and one row of double bearings 71 (N=M=1), and in which the end area 73 of the 15 cm module is defined by the separation area 72-1 of netting 27*g*.

A module 10 (with a thickness of 20 cm) is obtained by cutting the spacing wires 25 adjacent to the separation area 72-2, to include two single bearings 70 and one double bearing 71 (N=2 and M=1). In a similar way, modules of 25 and 30 cm may be obtained by cutting the spacing wires 25 adjacent to the respective separation areas 72-3 and 72-4.

Those netting portions which remain after trimming the modules of 15, 20 and 25 cm may usefuly be used to make partitions with various thicknesses in the building. In this way, this simple netting type may generate substantially all the modules required in the building while losing only very small portions of the wires 25.

The distance, referred to as Pd, between axes of the spacing wires 25 in the nettings 16 and 27 is substantially equal to four times the distance Pl minus two wire diameters, and equal to the width Wb of said elements 12.

Figure 11A:
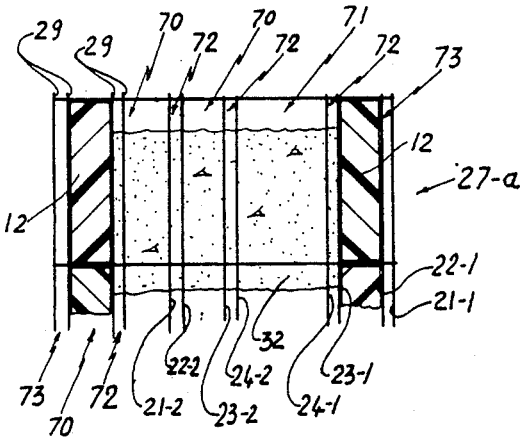
FIGS. 11*a*–11*h* are diagrammatic section views through modules with different thicknesses.
Figure 11B:
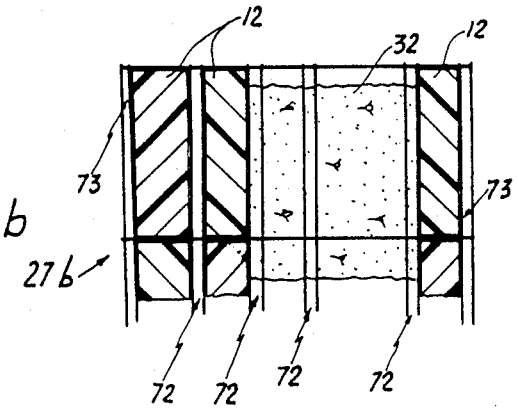
Figure 11C:
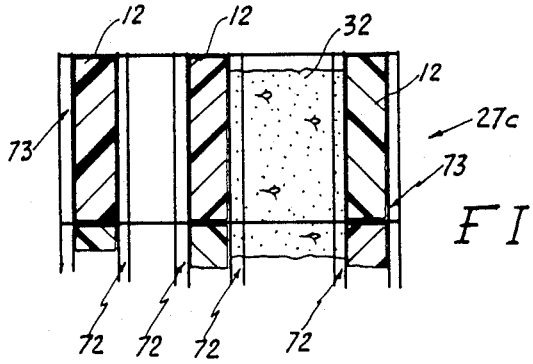
Figure 11D:
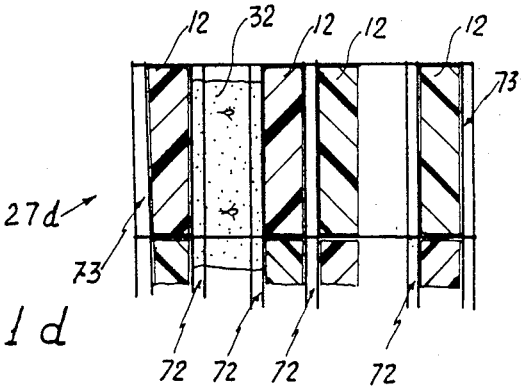
Figure 11E:
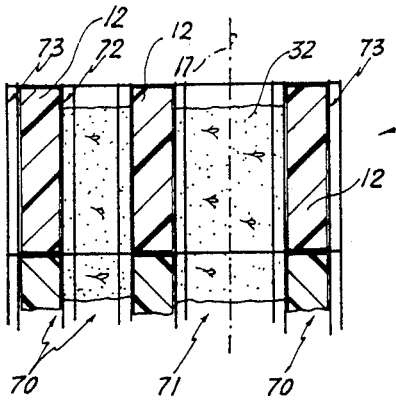
Figure 11F:
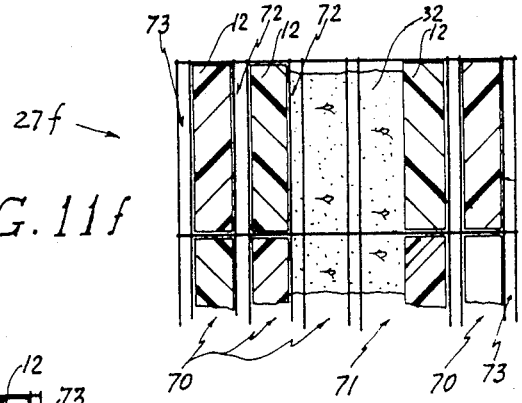
Figure 11G:
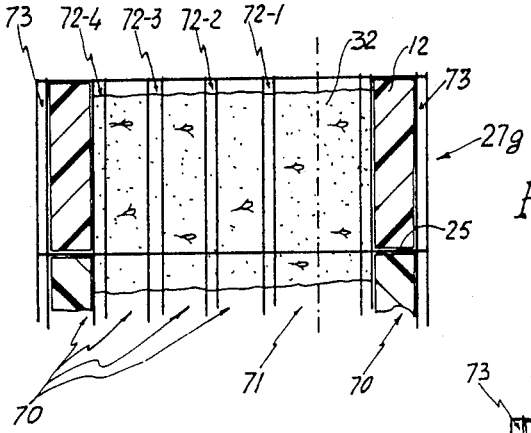
Figure 11H:
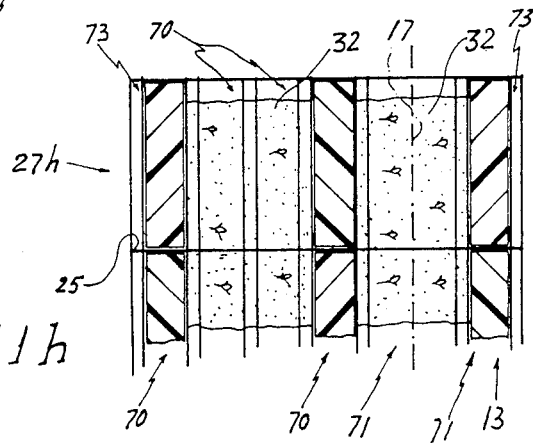

The FIGS. 11*a* and 11*h* show that it is possible to arrange the elements 12 in various locations in the netting. Moreover, the space between the elements 12 may be used as reinforcement for one or a plurality of concrete castings with different thicknesses, or as empty. Advantageously, the separation area 72 between two adjacent insulating layers may be used as an anticondensing area.

After forming the armatures 11, each element 12 is inserted, according to the contemplated use of module 16, 26, between the spacing wires 25 and in the locations 70 between the lengthwise wires 22 and 23, and by pairs in the locations 71 between the wires 24-1 and 24-2 of nettings 16, or else between the wires 24-1 and 28-1 and between the wires 24-2 and 28-2 of nettings 27. Inserting the elements 12 between the armature wires is made easier by the flexibility of the steel wires and because elements 12 are made of light material.

Figure 4:
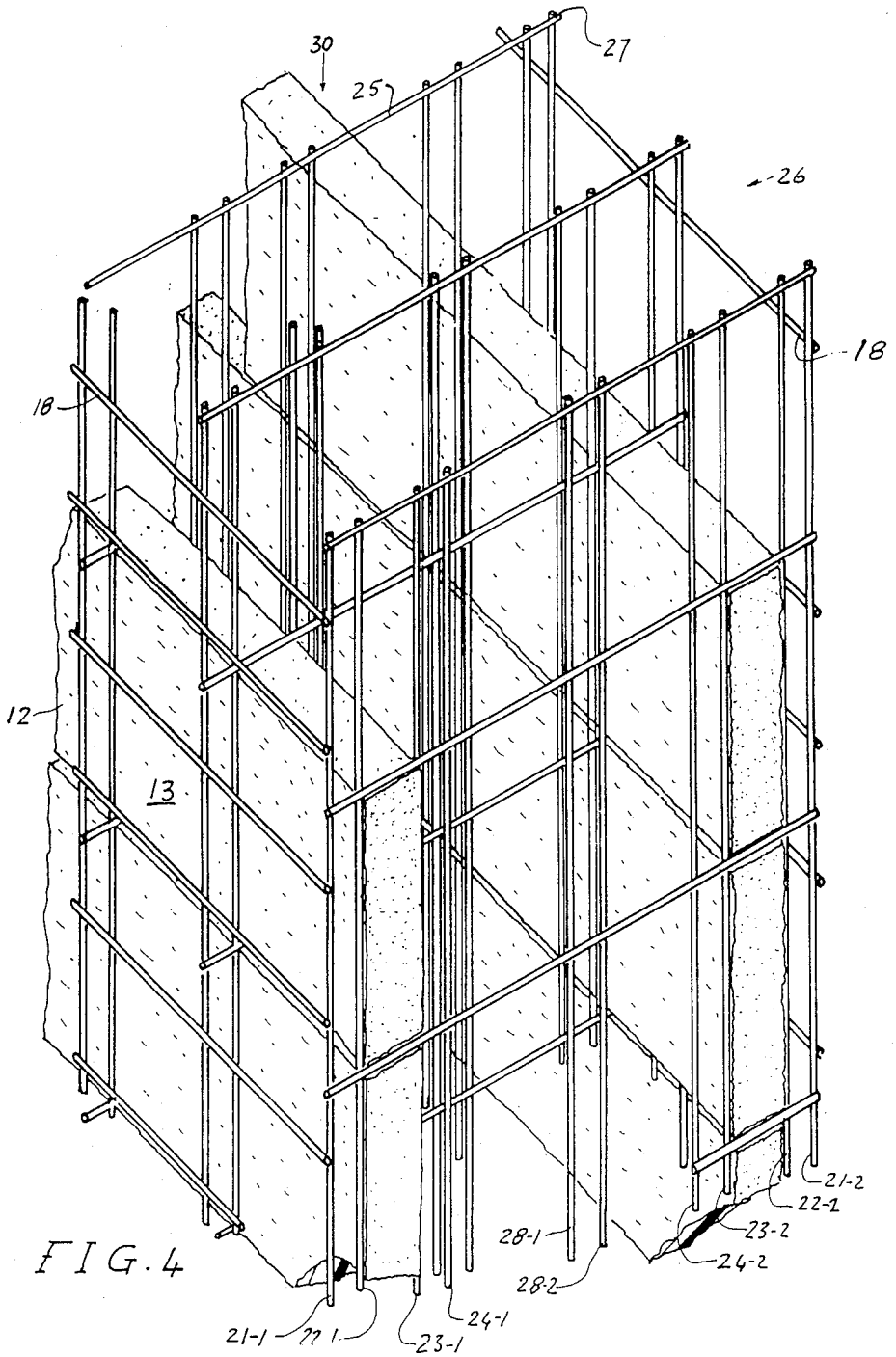
FIG. 4 is a diagrammatic perspective view of an alternate module according to the invention.

In the vertical structures 14, the elements 12 only fill that space bounded by the two pairs of lengthwise wires 22-1, 23-1 and 22-2, 23-2 from each succession of nettings 16 and 26. The elements 12 are arranged side by side and form, besides said vertical panel 13, a second continuous vertical panel 30 spaced from panel 13 by a space I1=2Pl+2 PS in the modules 10, and by a space I2=4Pl+3PS in the module 26 (FIG. 4).

Figure 3:
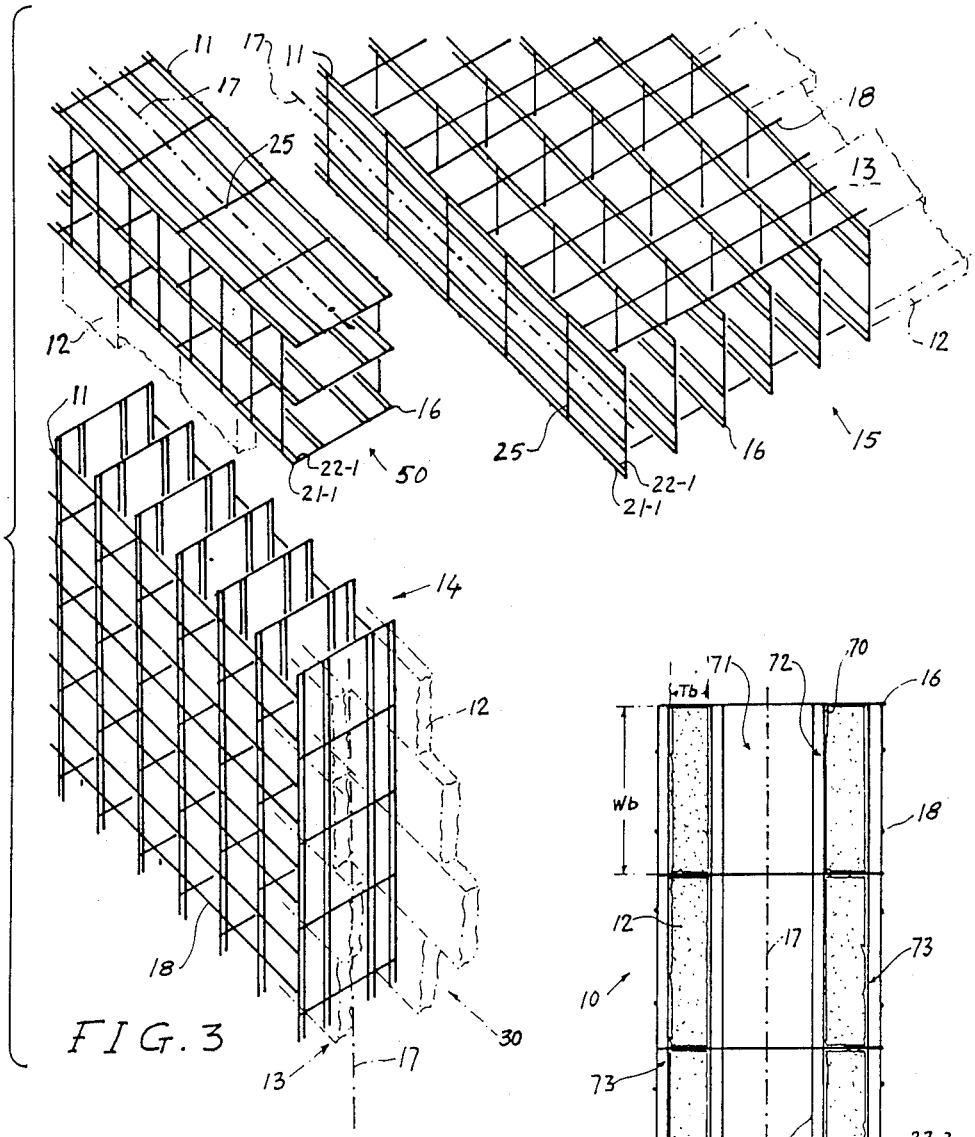
FIG. 3 is an exploded diagrammatic view showing several modules according to the invention.
Figure 3A:
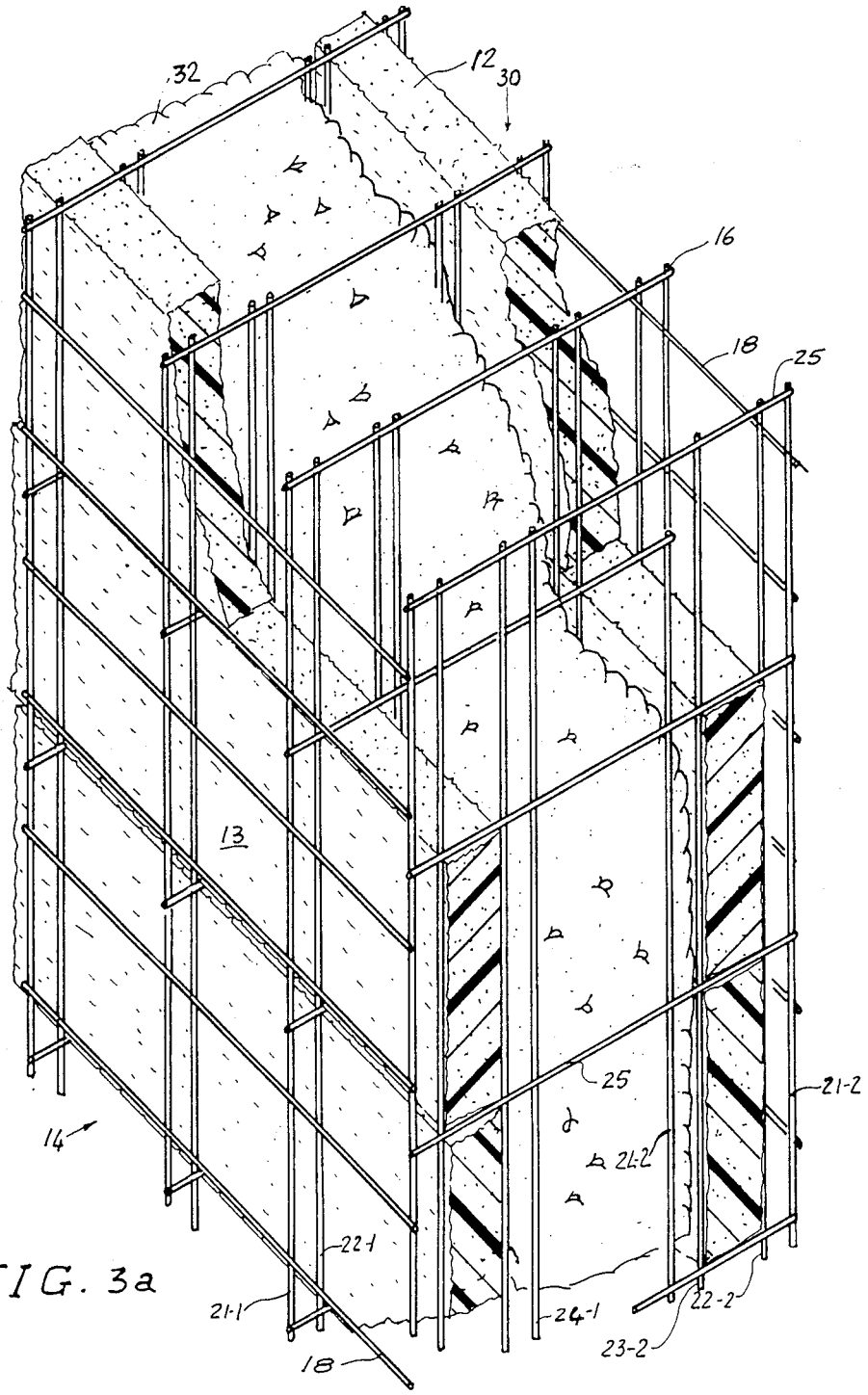
FIGS. 3*a*, 3*b* and 3*c* are diagrammatic perspective views of the modules shown in FIG. 3.
Figure 3B:
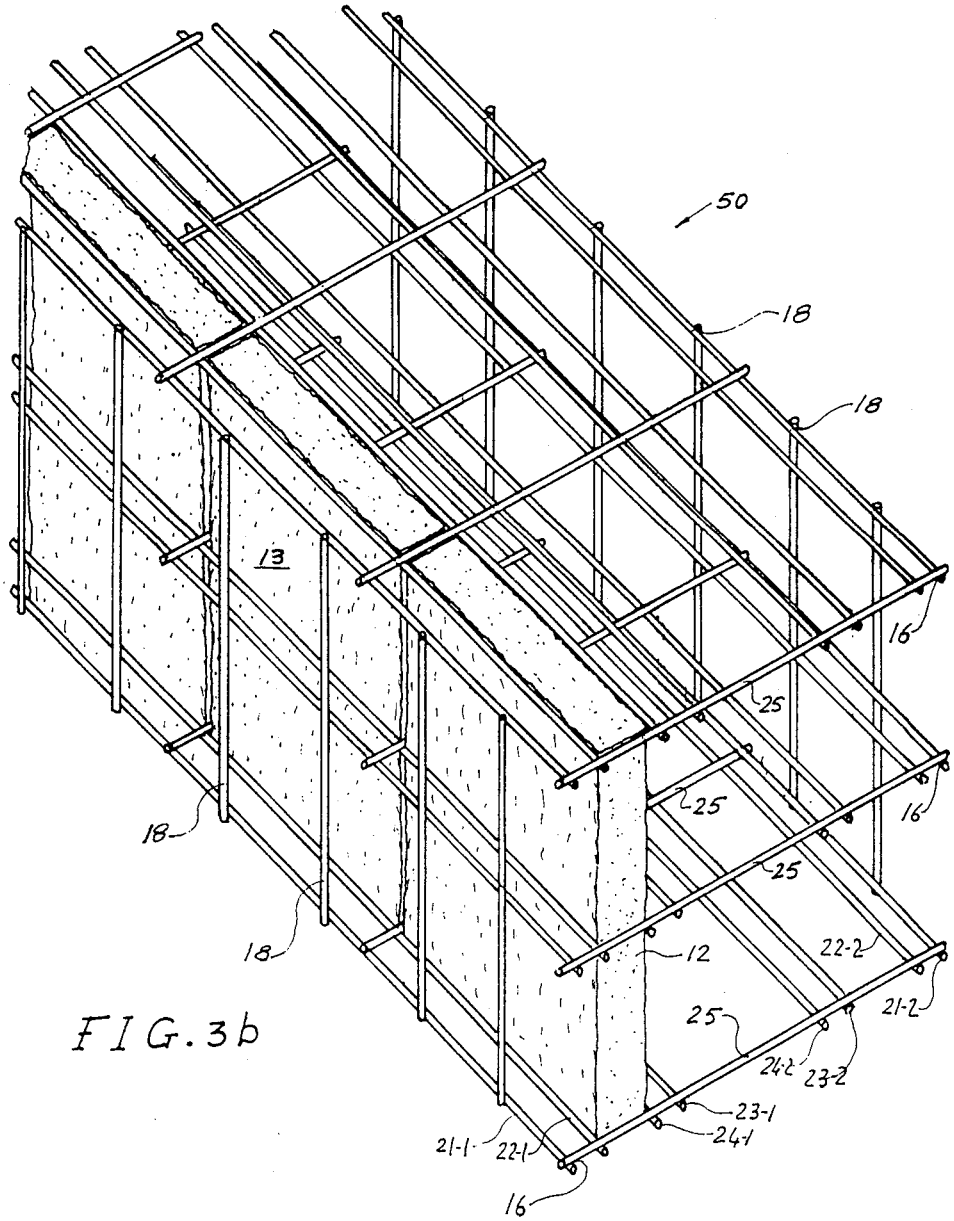
Figure 3C:
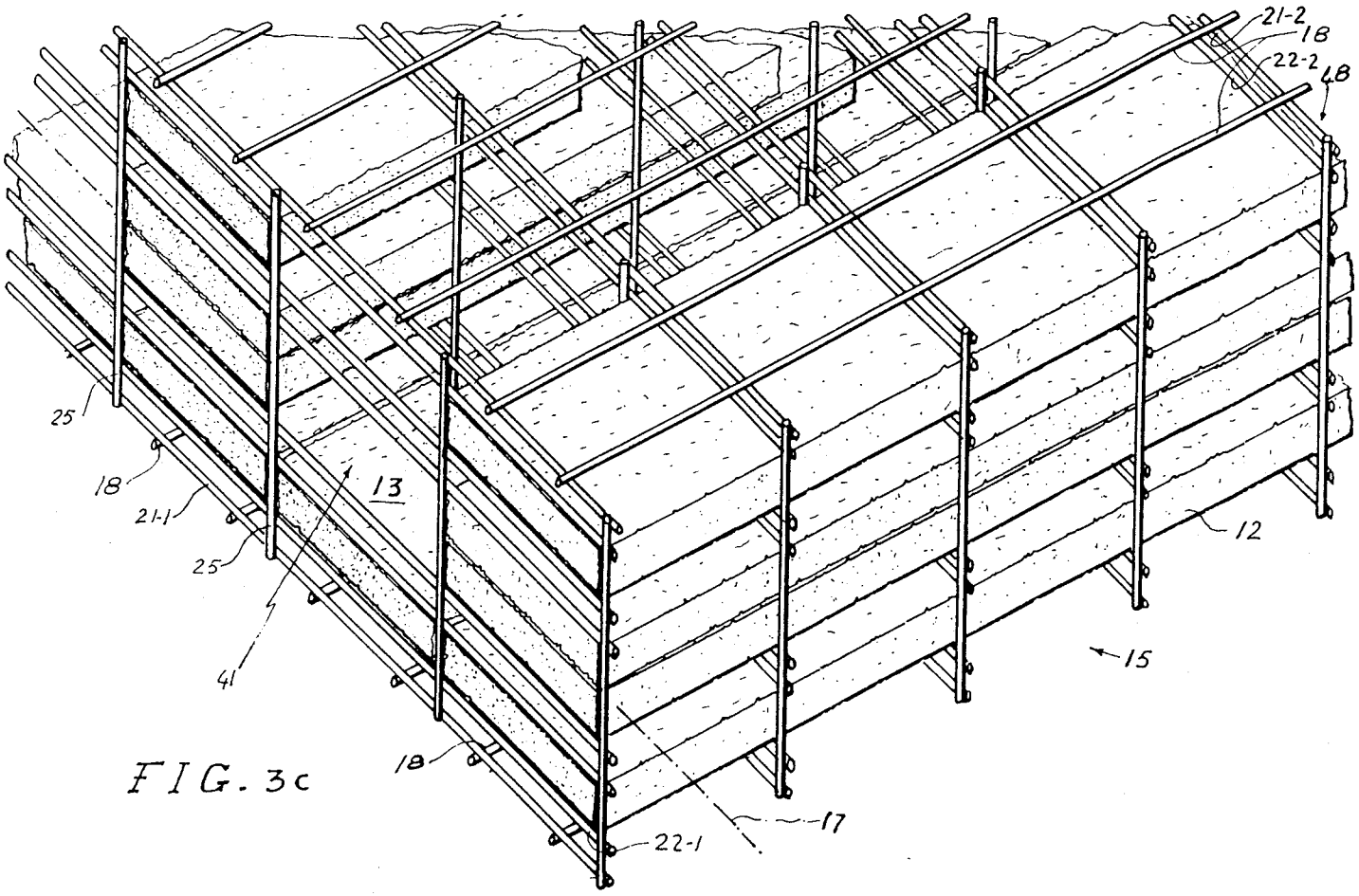

The spaces I1 and I2 may be used as lost shuttering for casting reinforced concrete 32 (FIG. 3*a*). The wire pairs 24-1, 24-2 and 28-1, 28-2 are embedded in the concrete casting and promote the positioning of the horizontal concrete irons 31 (FIG. 1) from an armature for casting concrete 32, while preventing at the same time the concrete irons 31 moving nearer the elements 12 and thus being deprived of concrete coating.

The modules 10, 26 are assembled together by means of small horizontal ladders 35 which are also made from welded steel wires. The small ladders 35 are provided with cross-wise wires 36, for a spacing I1 and spacing wires 37 having a pitch equal to half the pitch of nettings 16, 27.

The small ladders 35 are inserted under a slight stress into the spaces I1 of nettings 16, between the wires 24-1 and 24-2, or by pairs into the spaces I2 of nettings 27, between lengthwise wires 24-1, 28-1 and 24-2, 28-2.

The small ladders 35 are also used to align accurately a plurality of modules 10, 26, and to accurately positioned vertical concrete irons 33 for the reinforced concrete armature.

In anti-seismic or particularly stressed structures, the small ladders 35 may be made with cross-wise wires 36 which are so sized as to withstand stresses at right angle to panel 13, thus easing the load on the concrete irons 31.

The lengthwise wires 36 of the small ladders abut against the wires 24-1 and 24-2 of the nettings 16 and 27, insuring that the concrete irons 33 lie at such a distance from panels 13 and 30 so that these irons 33 may be thoroughly coated by the concrete casting, thus insuring the best engagement of the concrete with the armature. The spacing wires 37 further insure the accurate vertical positioning of the concrete irons 33.

With reference to FIGS. 1, 3, 5 and 6, in the horizontally-type structures 15, the elements 12 form a substantially continuous platform in the space between the wires 22-1 and 23-1, from the lower netting portion as shown in FIG. 3, so as to form the single panel 13.

The spacing between the other wires is partly taken-up by an array 48 of elements 12 superimposed along that side thereof in the direction of the longer dimension Wb of the elements 12. The arrays 48 are separated by lengthwise connecting spaces 41 which are used as shuttering for casting the concrete 32.

As an alternative, instead of using elements 12, the shuttering for casting concrete may be bounded by thin insulating elements 63 (FIG. 5) bearing on the spacing wires 25 next to interconnecting spaces 41 in the bearing spaces 71, thus sparing a marked insulation amount.

A portion of the concrete casting 32 spreads over the highest elements 12 and covers the lengthwise wires 21-2 and cross-wires 18. Said portion forms a top ceiling 42 (FIG. 5) with a thickness Tp+Ps, and it is provided with lower ribs 43 having a width equal to Wb or multiples thereof, which fill the interconnecting spaces 41.

Inside the concrete casting ribs 43, steel sections are embedded, for example high-grip bars 44, which are retained by stop wires 24-1. The number and cross-section of said bars 44 are chosen so as to withstand tensile stresses in the bottom portion of said structure 15. When required, other portions of the bars 44 will bear on the wires 21-1 to strengthen the ceiling, so as to withstand the tensile stresses of the upper structure portions.

Figure 5:
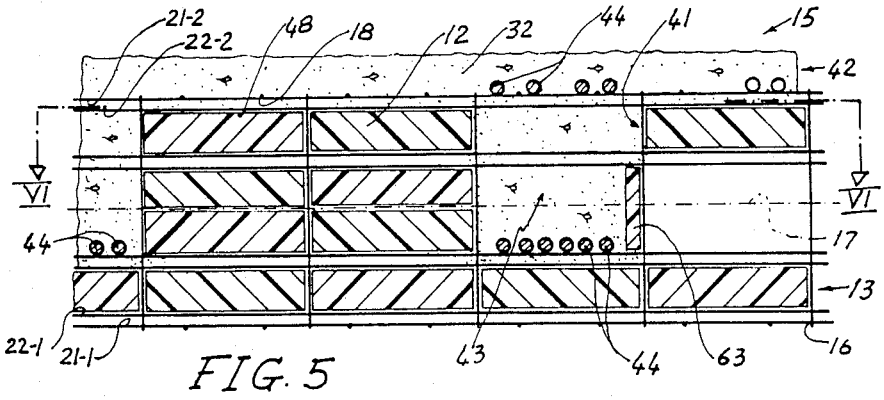
FIG. 5 shows a cross-section through a module shown in FIG. 3.
Figure 6:
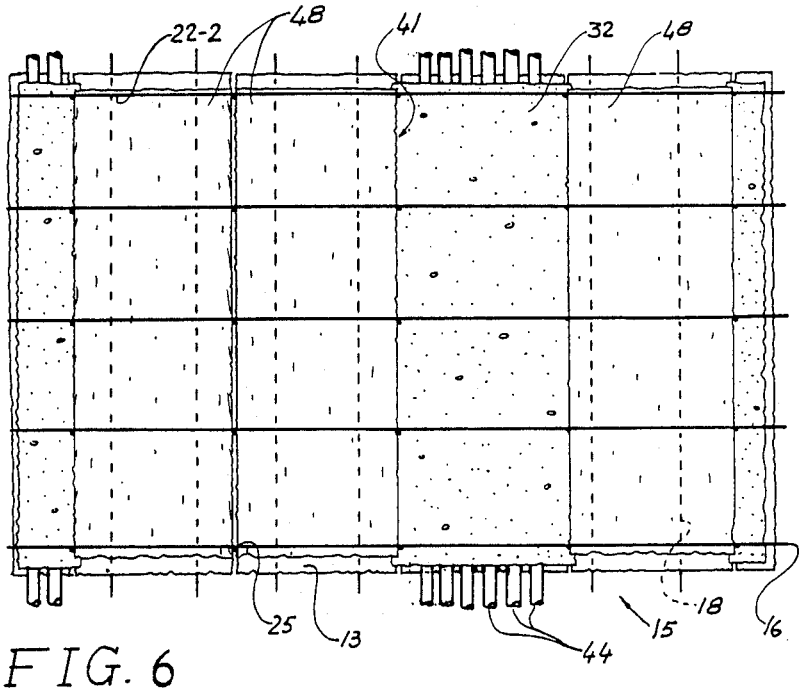
FIG. 6 is a section view along line VI—VI through the module shown in FIG. 5.
Figure 8:
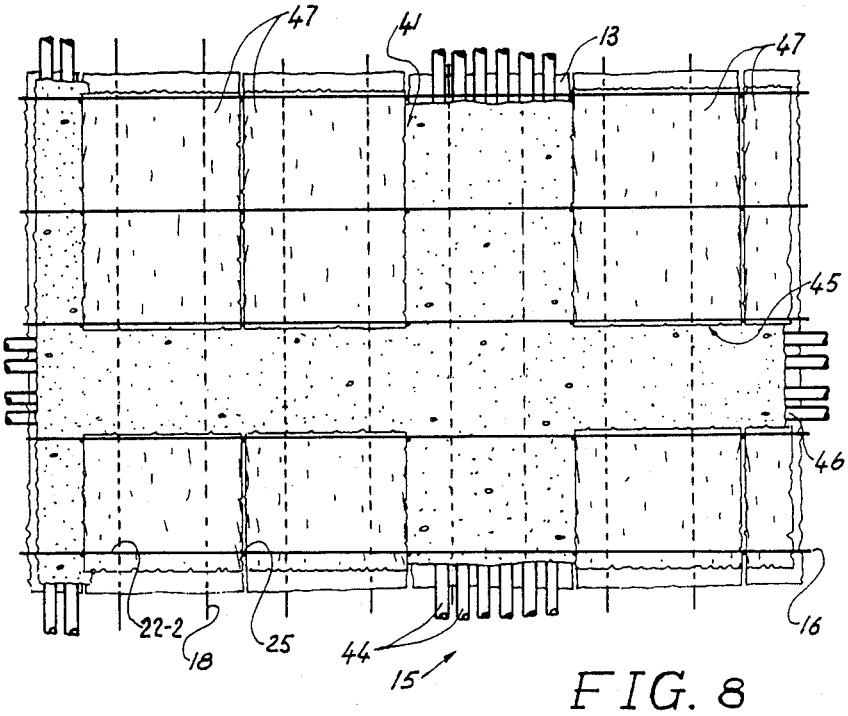
FIG. 8 shows a cross-section through a a module as shown in FIG. 3.

With reference to FIGS. 3 and 8, in those ceilings which require a cross-wise armature or reinforcement besides a lengthwise armature, the elements 12 (FIG. 8) have a length Lr which is shorter than the ceiling length Lg, and elements 12 are arranged to form detached portions 47. Portions 47 project from the lower panel 13 and bound the lengthwise spaces 41 and the cross-wise spaces 45, which are provided to receive steel bars 46 and a concrete casting which will comprise the cross-wise ribs of ceiling 42 (FIG. 5).

Alternately, instead of using bars 44, it is also possible to use sections with another shape. The use of a twin-T section 75 has been found particularly advantageous (FIG. 14).

The number of sections 75 is so selected as to have said sections withstand any loading of the complete ceiling.

In a module where Pl is 4 cm, use has advantageously been made of a standard section UNI 725-726, the cross-section of which is 80 mm high and 42 mm wide. The section is introduced in location 71 along the direction of the smaller dimension thereof to thus avoid all the obstacles due to possible faults in the alignment of the various nettings.

Figure 14:
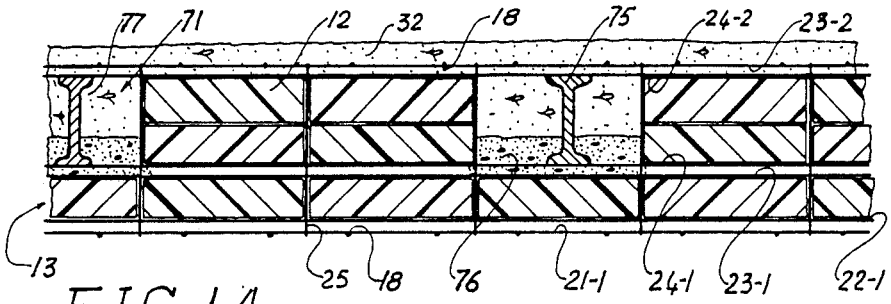
FIG. 14 is a section view through a module according to the invention, being used with twin-T sections.

The section is then rotated over at an angle of 90°, until it is located in the position as shown in FIG. 14.

The flexibility of wires 24-1 and 24-2 allows the necessary space to be obtained for such rotating. Even in this case, the required span is obtained by the bordering of the modules and a suitable length of section 75.

The armature sections and particularly the twin-T sections allow the pre-assembling of a ceiling or a wall on site, that is before the ceiling or wall is arranged in a final position and the possible concrete casting.

Figure 15:
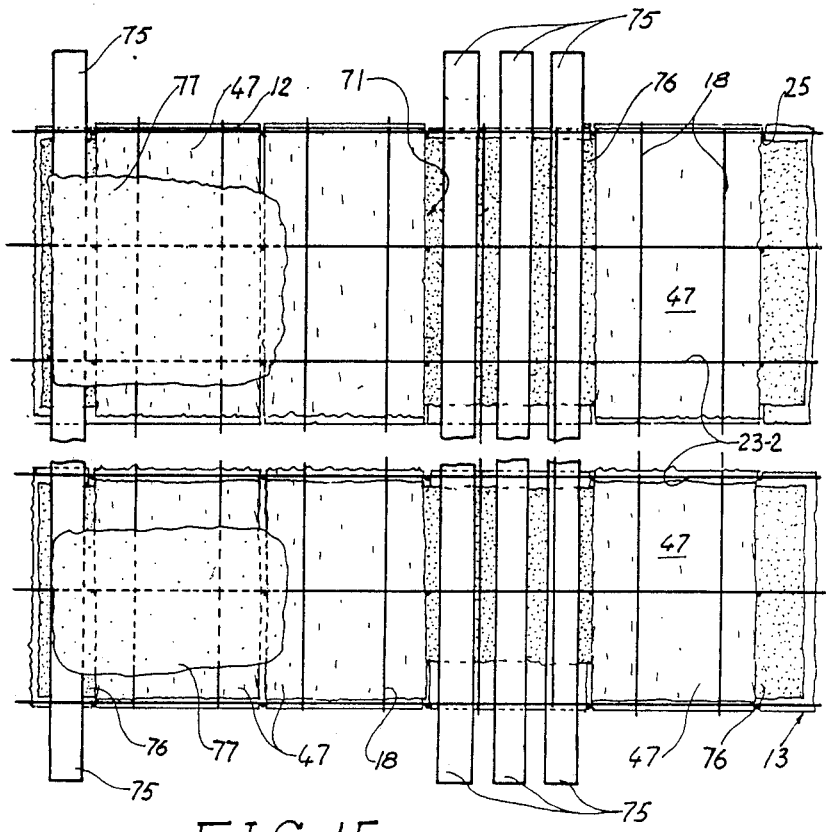
FIG. 15 is a diagrammatic plan view of the module as shown in FIG. 14.

For this purpose, the various modules 10, 26 (FIG. 15) intended to form ceilings, bear on a datum plane.

The sections 75 are introduced into the spaces 71 of the modules, and the length of the sections 75 is selected so that ends of the sections project from the modules over a length which is substantially equal to the thickness of the vertical structure with which the ceiling is to be assembled.

Concrete 76 is poured in the interconnecting spaces 41 between the arrays 48 to cover the wires 24-1, the base and part of section 75.

The concrete layer 76 is vibrated to insure a good distribution of the concrete in that area lying between the base of section 75 and panel 13. The pre-assembly of the other ceilings may be made by using the previously-assembled ceiling as a bearing base with the help of a suitable levelling surface bearing on the wires 18 of the underlying ceiling.

The pre-assembled ceiling will be used after the casting 76 has set. Said ceiling is lightweight due to the limited thickness of the reinforced concrete being used, and it is self-bearing by means of the balks it is part of.

It may thus easily be transported and may be used widely for building houses, even in areas which are difficult to reach.

Moreover, due to the remarkable strength thereof, use said ceiling does not require intricate scaffoldings, and it is enough to provide a few small supporting beams and a few corresponding stays.

After the pre-assembled ceiling is located in place, the ceiling proper may be completed with an additional casting of concrete 77 superimposed an said casting 76. A light filling material, such as cell-like cement, etc, may be used as an alternative to the concrete casting.

Such a ceiling has a reduced thickness and a low density. FIG. 14 shows an insulated ceiling with a thickness about 15 cm, which is particularly advantageous to cover large industrial structures.

In ceilings with a larger thickness, which make use of modules 26 as shown in FIG. 4, two superimposed sections 75 are inserted in the corresponding bearing spaces 71.

Pre-assembling may also be done with modules having various types of cross-sections, for example with tube-like cross-sections having circle-shaped, rectangular or other cross-sections, able to withstand all the stresses to which the structure will be subjected.

Said tube-like sections may be used to make ducts for electric cables, for hydraulic equipment pipes or for air-conditioning lines.

Figure 9:
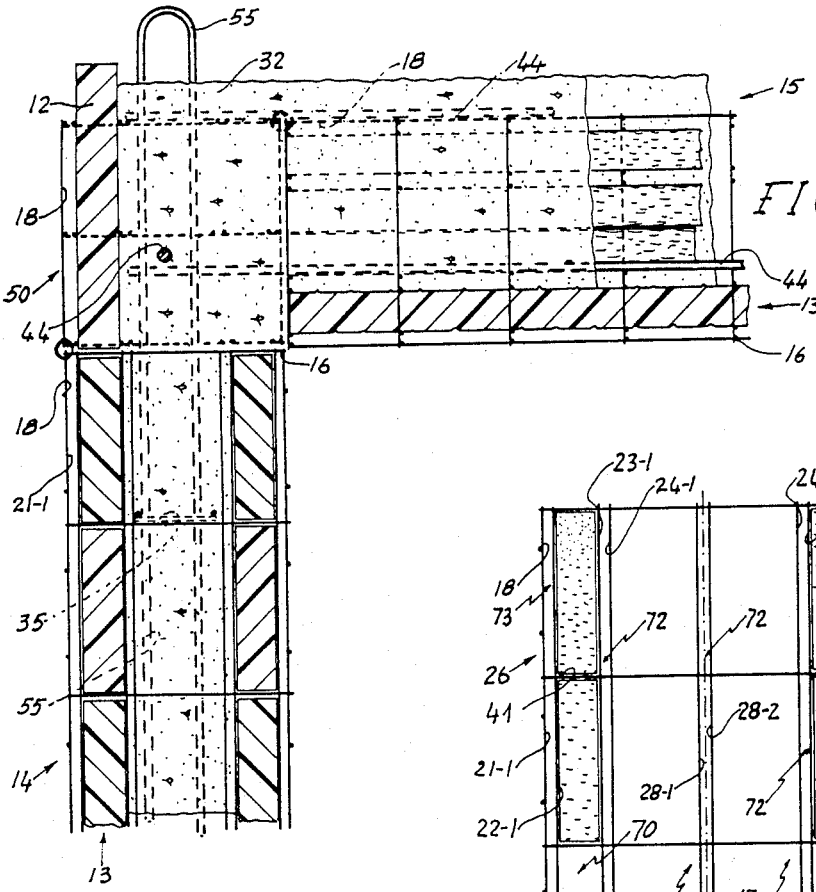
FIG. 9 is a diagrammatic view of a connecting area between two modules shown in FIG. 3.
Figure 7:
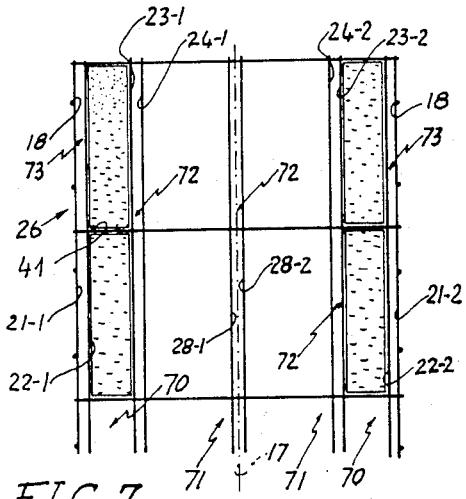
FIG. 7 shows a detail of the embodiment shown in FIG. 4.

With reference to FIGS. 3 and 9, the structures 15 and 14 may be connected by means of connecting modules 50, which comprise a limited number (three or four) nettings 16, 26 arranged besides both structures, in such a way that the nettings 16, 26 lie horizontally and the wires 18 lie vertically. The modules 50 have a similar structure to the modules 10 and 26, but the elements 12 of module 50 are arranged vertically, the length of elements 12 so equal to the thickness of structure 15, and the element 50 full only the outermost area of the module 50, in such a way as to comprise a shuttering element which holds the concrete casting 32.

The connection between modules 10, 26 and modules 50 is made, in a very simple way, with U-shaped bars 55, which retain the modules proper between them.

In a horizontal structure 15 using nettings 27h (FIG. **11*h*), the panel 13 may be used as ceiling. In such a case, the double support or bearing 71 may be kept open and used to pass electric cables, hydraulic means or air lines. Moreover portions from panel 13 and supporting wires may be cut to locate lighting fixtures in bearing locations 71**.

In a particular embodiment, given by way of example only, the steel wires are zinc-coated against oxidizing and are 2.2 mm in diameter. The width Wb of elements 12 is 154 mm, the thickness Tb is 38 mm, the spacing between the nettings 16 and 27 is 98 mm, and the pitch of the cross-wise wires 18 is 78 mm. The horizontal structures 15 derived from said modules 10, have a ceiling 42 wherein Tp is 5 cm, for a total thickness of 25 cm, in such a way as to obtain spans up to 6 m.

The ceilings made by means of said modules 26 have, on the other hand, a top ceiling with a thickness Tp2 equal to 6 cm for a total ceiling thickness equal to 35 cm, in such a way as to obtain spans up to 10 m.

Either in the vertical structures 14 or in the horizontal structures 15, the end space 73 between wires 21-1 and 22-2 and panel 13, and the space between panel 13 and wires 21-2 and 22-2, is filled with a coating composition. Vertical structure 14 is treated in the same way.

Two modules 10, 26 or more of a structure 14 may be assembled easily with the end edges, thereof properly positioned by inserting one or more of small ladders 35 in the spaces I1 to obtain a good alignment of the modules.

The wires 21-1, 21-2, which lie on the module edges, are connected by means of a ring 49 (FIG. 1) or a plurality of metal rings wound around the wire pairs 21, in the area of the cross-wise wires 18 for example.

The width of elements 12, is Wb=4Tb plus the diameter of the spacing wire, and is equal to the spacing between two spacing wires 25.

Such dimensions are particularly advantageous in the modules 60 (FIG. 10) having a netting structure 16 identical with the structure of modules 50. The nettings 60 are provided with pieces of elements 12 inserted between the wires 22 and 23 to form one side 61. The one side of Wb size contacts a netting 16. Due to the size selection as defined hereinabove for the nettings 16 and elements 12 and 62, the edges of an element 62 with a thickness Tb, will contact and be slightly forcefully pushed between the cross-wise wires 18 and side 61.

The length wise wires of the building module of the present invention can be considered as separating that module into various sections. For example, with reference to FIG. 1, the wires 22-1 and 23-1 of the nettings 16 bound a first section having a width equal to the thickness Tb of element 12, wires 24-1 and 24-2 of the nettings 16 bound a second section of the module having a width equal to twice that thickness, and wires 22-2 and 23-2 of the nettings bound a third section of the module having a width equal to the thickness Tb of the element 12. Alternatively, with the building module shown in FIG. 14, length wise wires 22-1 and 23-1 of the module bound a first section having a width having equal to the thickness of element 12, and length wise wires 24-2 and 24-1 of the module bound a second section having a width equal to twice the thickness of element 12.

In addition, the spacing wires 25 of the building module of the present invention may be considered as separating these sections of the module into subsections. For instance, with reference to FIG. 14, the second section of the module can be considered as including first, second and third subsections. As viewed in FIG. 14, the first of these subsections is bounded on the right and left by a first and second spacing wire, respectively, a second of these subsections is bounded on the right and left, respectively, by this second spacing wire and a third spacing wire, and the third of these subsections is bounded on the right and left, respectively, by this third spacing wire and a fourth spacing wire.

Figure 10:
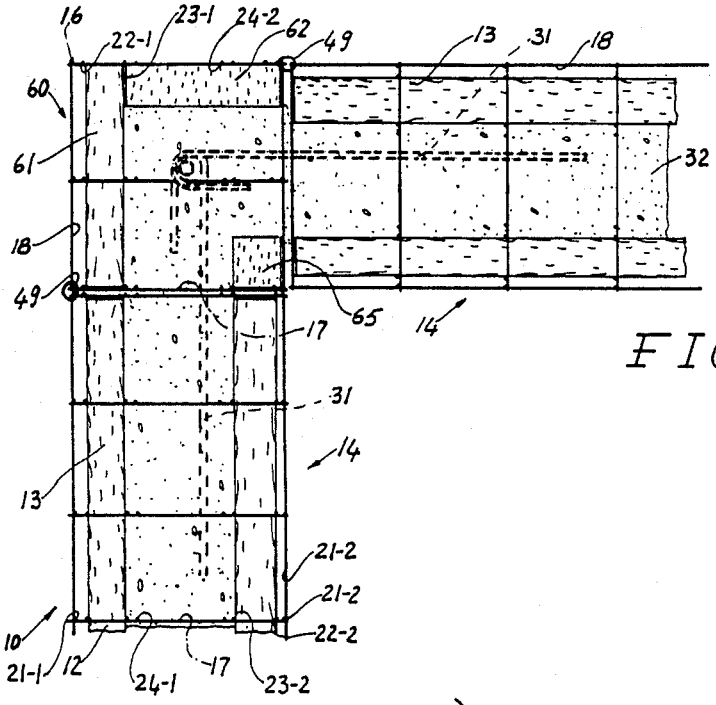
FIG. 10 is a diagrammatic view of another connecting area between two modules according to the invention.

As shown in FIG. 14, a first and a second element 12 may be located and supported in the above-mentioned first subsection, a third and a fourth element 12 may be located and supported in the above-mentioned third subsection, and iron bar 75 horizontally extends across and is supported by the nettings of this module in the above-described second subsection, between the first and third subsections, to reinforce the module against transverse forces. As shown in FIG. 14, bar 75 has a height equal to twice the thickness of element 12, and extends between wires 24-1 and wires 24-2 of the module.

with reference to FIG. 10, module 60 is particularly useful for connecting two structures 14 arranged at 90° to one another. In such a case, the side 61 of module 60 is align with panel 13 of a module 10. The panel 13 of the other module 14 is aligned with element 62. The connection of the modules is completed by a square cross-section element 65, with a side length Tb, located opposite the corner formed by side 61 and element 62. The connection proper is made by using junction helixes between the various end wires of the modules, by the possible extension of the concrete irons 33 or by means of a concrete casting 32.

Figure 12:
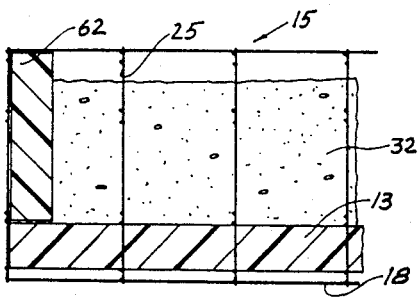
FIG. 12 is a diagrammatic view of another example for the use of a module according to the invention.

The module 60 may also be used with a horizontal structure 15 (FIG. 12). In such a case, the ends of elements 12 are aligned with the ceiling panel 13 and the element 62 defines a side shoulder for the concrete casting 32. This arrangemet may be used to make galleries, suspended gardens, etc. and other similar structures.

In that case where it is not possible to preassemble the ceiling, the horizontal structures 15 may be used in a conventional way, to provide support before casting the concrete. The framings 11 and elements 12 provide, in any case, good resistance to the flow of the concrete, as well as to the weight thereof. Moreover, the presence of spaces between said elements 12 supported by wires 22-1 and 23-1 does not raise any problem for the concrete compactness, after setting thereof.

Figure 13:
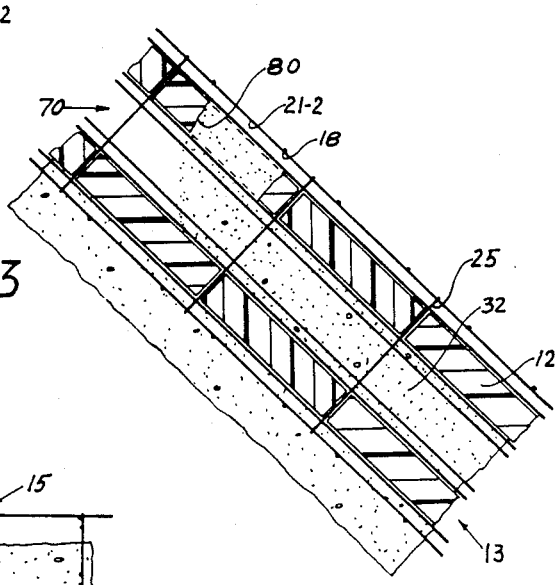
FIG. 13 is a diagrammatic view of another example for the use of the module according to the invention.

The particular arrangement of the nettings 16 in the horizontal structures 15 and the use of said modules 50 and 60 make it possible to obtain varying-length spans, by making use of identical narrow-width modules, without requiring the use of special structural elements such as small stays and similar devices. FIG. 13 shows a module 10 with double insulation in a slanting structure which is used, to make roofs. In such a case, the concrete cast into the free spaces between both panels 12 is done so through a hole 80 provided in an element 12 of that panel which comprises the top roof insulation.

Figure 16:
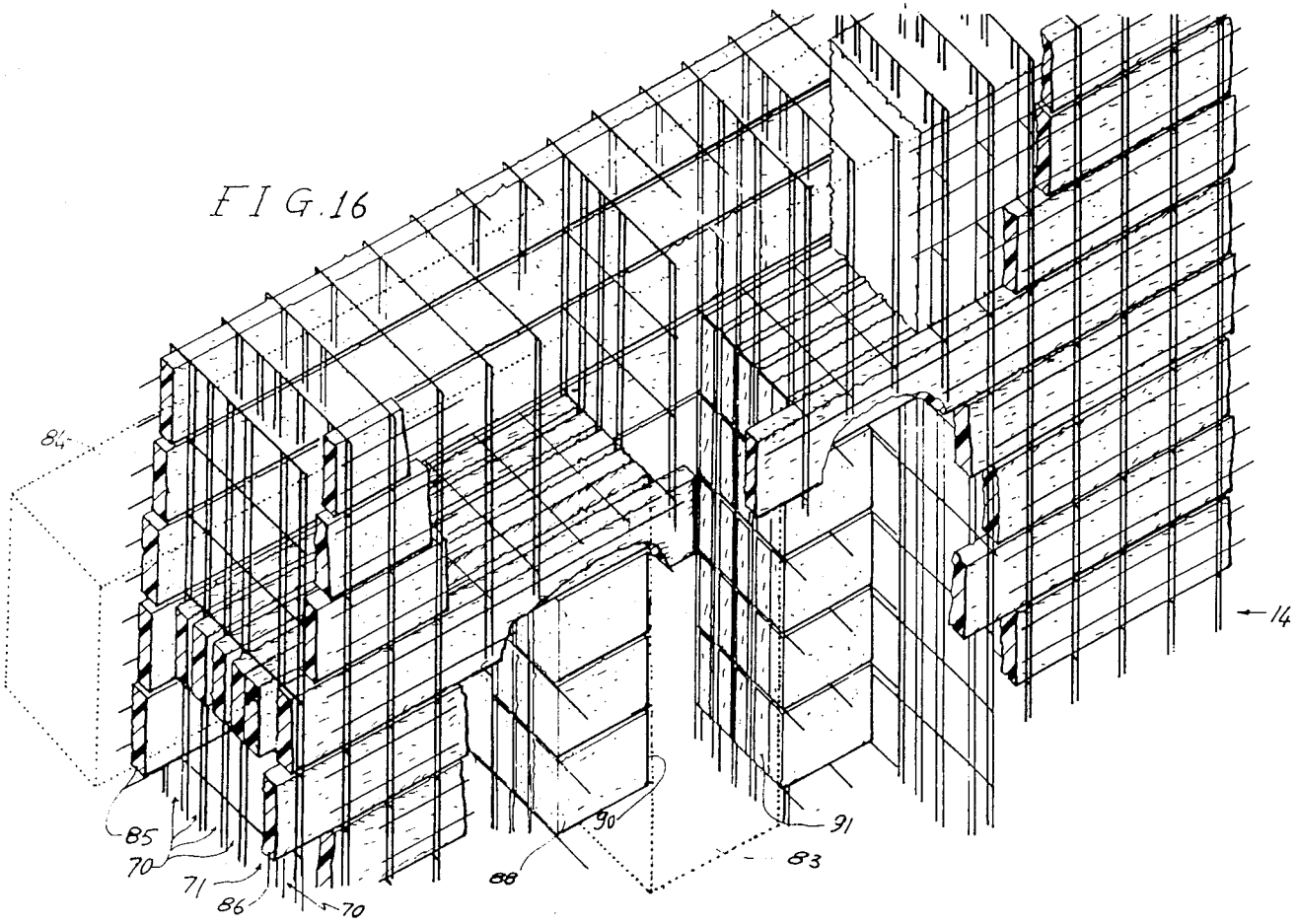
FIG. 16 is a general diagrammatic view.

FIG. 16 shows modules having nettings **27*h* which are provided with five single bearing spaces 70 and one double bearing space, according to the diagram in figure 11*g*. This may be used to make simultaneously jointing zones between the concrete pillars 83 and the horizontal beams 84 in a vertical structure 14. The structure walls are made by means of two panels 85 and 86 comprised of elements 12 retained inside the spaces 70**.

The shuttering for the beam 84 is made sidewise with two panels 85 and 86, and underneath with three single elements 12 and two other elements 12 which provide a series of spaces 70 and 71 lying between the panels 85 and 86. The shuttering for the pillar 83 is in turn obtained with pieces from elements 12, the ends of which are aligned along two nettings and which define two retaining surfaces 90 and 91 for casting the concrete. The beam 84 and pillar 83 may be completed by armature sections in the shape of bars, or by using another kind of steel section in conformity with the reinforced concrete design data.

A structure of the kind as shown in FIG. 16 may have a plurality of pillars 83, and the beam 84 may extend downwards and be provided with additional supports for the irons 41, 44. Those portions lying between the pillars 83 and the beam 84 may be used to define the openings for the doors, by cutting the required openings in the panels 85 and 86 and the armature of reinforcement wires 11.

We claim:

1. A prefabricated building module, comprising:

a plurality of nettings, each netting having longitudinal and transverse axes, and including (i) a plurality of longitudinal wires extending along the longitudinal axis of the netting, and (ii) a plurality of spacing wires extending along the transverse axis of the netting, connected to the longitudinal wires and holding the longitudinal wires spaced apart and parallel to each other;

a plurality of cross-wires connected to the nettings and holding the nettings spaced apart and substantially parallel to each other; and a plurality of panel members supported by the nettings, each of the panel members having a width equal to a preset distance;

the plurality of longitudinal wires of each netting including (i) a first wire defining a front edge of the netting, (ii) a second wire spaced from and located rearward of the first wire, (iii) a third wire spaced from and located rearward of the second wire, (iv) a fourth wire spaced from and located rearward of the third wire, (v) a fifth wire spaced from and located rearward of the fourth wire, (vi) a sixth wire spaced from and located rearward of the fifth wire, (vii) a seventh wire spaced from and located rearward of the sixth wire, and (viii) an eighth wire spaced from and located rearward of the seventh wire, and defining a rear edge of the netting;

the second and third wires of each netting being spaced apart the preset distance;

the fourth and fifth wires of each netting being spaced apart a distance equal to twice said preset distance;

the sixth and seventh wires of each netting being spaced apart the preset distance;

each of the spacing wires of each netting including (i) a first load bearing segment bounded by the second and third wires of the netting, having a length equal to said preset distance and adapted to help support one of the panel members, (ii) a second load bearing segment bounded by the fourth and fifth wires of the netting, having a length equal to twice the present distance and adapted to help support two of the panel members, and (iii) a third load bearing segment bounded by the sixth and seventh wires of the netting, having a length equal to said preset distance and adapted to help support one of the panel members;

the first, second, third, fourth, fifth, sixth, seventh and eighth wires of each netting being aligned respectively with the first, second, third, fourth, fifth, sixth, seventh and eighth wires of all the other nettings;

the second wires of the nettings and the third wires of the nettings bounding a first section of the module having a uniform width equal to said preset distance;

the fourth wires of the nettings and the fifth wires of the nettings bounding a second section of the module having a uniform width equal to twice said preset distance;

the sixth wires of the nettings and the seventh wires of the nettings bounding a third section of the module having a uniform width equal to said preset distance;

the plurality of panel members being located in and at least substantially filling at least a selected one of the first, second and third sections;

the first wires of the netting defining a front plane of the building module;

the first wires of the nettings and the second wires of the nettings bounding a front clearance space separating the first section of the module from the front plane of the building module;

the eighth wires of the nettings defining a back plane of the building module;

the seventh wires of the nettings and the eighth wires of the nettings bounding a back clearance area separating the third section of the module from the back plane of the building module;

the third wires of the nettings and the fourth wires of the nettings bounding a first internal clearance area having a uniform width and separating the first section of the module from the second section thereof; and the fifth wires of the nettings and the sixth wires of the nettings bounding a second internal clearance area also having a uniform width and separating the second section of the module from the third section thereof.

2. A prefabricated building module according to claim 1, wherein:

the plurality of spacing wires of each netting includes a first spacing wire, the first spacing wire of each netting is horizontally aligned with the first spacing wire of all of the other nettings; and the building module further includes a horizontally extending ladder extending across and supported by the first spacing wires of the netting.

3. A prefabricated building module according to claim 2, wherein the ladder includes:

a first lengthwise wire abutting against each of the fourth wires of the nettings;

a second lengthwise wire abutting against each of the fifth wires of the nettings; and a plurality of cross-wires connected to and extending between the first and second lengthwise wires to reinforce the fourth wires of the nettings and the fifth wires of the nettings against transverse forces.

4. A prefabricated building module according to claim 3, wherein the uniform width of each of the front, back, first inside and second inside clearance areas is equal to one-fourth the preset distance.

5. A prefabricated building module, comprising:

a plurality of nettings, each netting having longitudinal and transverse axes, and including (i) a plurality of longitudinal wires extending along the longitudinal axis of the netting, and (ii) a plurality of spacing wires extending along the traverse axis of the netting, connected to the longitudinal wires and holding the longitudinal wires spaced apart and parallel to each other;

a plurality of cross-wires connected to the nettings and holding the nettings spaced apart and substantially parallel to each other; and a plurality of panel members supported by the nettings;

the plurality of longitudinal wires of each netting including (i) a first wire defining a front edge of the netting, (ii) a second wire spaced from and located rearward of the first wire, (iii) a third wire spaced from and located rearward of the second wire, (iv) a fourth wire spaced from and located rearward of the third wire, (v) a fifth wire spaced from and located rearward of the fourth wire, (vi) a sixth wire spaced from and located rearward of the fifth wire, (vii) a seventh wire spaced from and located rearward of the sixth wire, and (viii) an eighth wire spaced from and located rearward of the seventh wire, and defining a rear edge of the netting;

each of the spacing wires of each netting including (i) a first segment bounded by the second and third wires of the netting and adapted to help support one of the panel members, (ii) a second segment bounded by the fourth and fifth wires of the netting, and (iii) a third segment bounded by the sixth and seventh wires of the netting and adapted to help support one of the panel members;

the first, second, third, fourth, fifth, sixth, seventh and eighth wires of each netting being aligned respectively with the first, second, third, fourth, fifth, sixth, seventh and eighth wires of all the other nettings;

the second wires of the nettings and the third wires of the nettings bounding a first section of the module;

the fourth wires of the nettings and the fifth wires of the nettings bounding a second section of the module;

the sixth wires of the nettings and the seventh wires of the nettings bounding a third section of the module;

the plurality of panel members being located in and at least substantially filling at least a selected one of the first, second and third sections;

the first wires of the nettings defining a front plane of the building module;

the first wires of the nettings and the second wires of the netting bounding a front clearance space separating the first section of the module from the front plane of the building module;

the eighth wires of the nettings defining a back plane of the building module;

the seventh wires of the nettings and the eighth wires of the nettings bounding a back clearance area separating the third section of the module from the back plane of the building module;

the third wires of the nettings and the fourth wires of the nettings bounding a first internal clearance area having a uniform width and separating the first section of the module from the second section thereof; and the fifth wires of the nettings and the sixth wires of the nettings bounding a second internal clearance area also having a uniform width and separating the second section of the module from the third section thereof.

6. A prefabricated building module according to claim 5, wherein:

each of the panel members has a width equal to a preset distance;

the second and third wires of each netting are spaced apart the preset distance, and the first segment of each spacing wire has a length equal to said preset distance;

the sixth and seventh wires of each netting are spaced apart the preset distance and the third segment of each spacing wire has a length equal to said preset distance;

the first section of the module has a uniform width equal to said preset distance;

the second section of the module has a uniform width equal to twice said preset distance; and the third section of the module has a uniform width equal to said preset distance.

7. A prefabricated module according to claim 50, wherein the fourth and fifth wires of each netting are spaced apart a distance equal to twice said preset distance and the second segment of each spacing wire has a length equal to twice the preset distance.

8. A prefabricated building module according to claim 7, wherein the second segment of each spacing wire is adapted to support at least one of the panel members, or to be embedded in a concrete casting reinforced with iron bars.

9. A prefabricated building module, comprising:

a plurality of nettings, each netting having longitudinal and transverse axes, and including (i) a plurality of longitudinal wires extending along the longitudinal axis of the netting; and (ii) a plurality of spacing wires extending along the transverse axis of the netting, connected to the longitudinal wires and holding the longitudinal wires spaced apart and parallel to each other; and a plurality of panel members supported by the nettings, each of the panel members having a width equal to a preset distance;

the plurality of longitudinal wires of each netting including (i) a first wire defining a front edge of the netting, (ii) a second wire spaced from and located rearward of the first wire, (iii) a third wire spaced from and located rearward of the second wire, (iv) a fourth wire spaced from and located rearward of the third wire, (v) a fifth wire spaced from and located rearward of the fourth wire, and (vi) a sixth wire spaced from and located rearward of the fifth wire, and defining a rear edge of the netting;

the second and third wires of each netting being spaced apart substantially said preset distance;

the fourth and fifth wires of each netting being spaced apart substantially twice said preset distance;

each of the spacing wires of each netting including (i) a first load bearing segment bounded by the second and third wires of the netting, having a length equal to said preset distance and adapted to help support one of the panel members, and (ii) a second load bearing segment bounded by the fourth and fifth wires of the netting, having a length equal to twice said preset distance and adapted to help support two of the panel members;

the first, second, third, fourth, fifth and sixth wires of each netting being aligned respectively with the first, second, third, fourth, fifth and sixth wires of all the other nettings;

the second wires of the nettings and the third wires of the nettings bounding a first section of the module having a uniform width equal to said preset distance;

the fourth wires of the nettings and the fifth wires of the nettings bounding second section of the module having a uniform width equal to twice said preset distance;

the plurality of panel members being located in and at least substantially filling at least a selected one of the first and second sections;

the first wires of the nettings defining a front plane of the building module;

the first wires of nettings and the second wires of the nettings bounding a front clearance space separating the first section of the module from the front plane of the building module;

the sixth wires of the nettings defining a further plane of the building module parallel to the front plane;

the fifth wires of the nettings and the sixth wires of the nettings bounding a back clearance area separating the second section of the module from the further plane of the building module; and the third wires of the nettings and the fourth wires of the nettings bounding an internal clearance area having a uniform width and separating the first section of the module from the second section thereof.

10. A prefabricated building module according to claim 9, wherein:

said plurality of panel members includes (i) a first group of panel members filling the first section of the module, and (ii) a second group of panel members located in the second section of the module, said second group of panel members including first, second, third and fourth panel members;

the plurality of spacing wires of each netting includes a first, second, third and fourth spacing wire;

the first, second, third and fourth spacing wires of each netting are aligned, respectively, with the first, second, third and fourth spacing wires of all the other nettings;

the second section of the module includes first, second and third subsections;

said first subsection is bounded by the first and second spacing wires of the nettings;

said second subsection is bounded by the second and third spacing wires of the nettings;

said third subsection is bounded by the third and fourth spacing wires of the nettings;

said first and second panel members are located and supported in said first subsection;

said third and fourth panel members are located and supported in said third subsection; and the building module further includes a horizontally extending iron bar extending across and supported by the nettings, in said second sub section, between the frst and the third sub sections, to reinforce the module against transverse forces.

11. A prefabricated building module according to claim 10, wherein said iron bar has a transverse height equal to twice the preset distance, and said iron bar extends between the fourth and the fifth longitudinal wires of the nettings.

* * * * *

UNITED STATES PATENT AND TRADEMARK OFFICE

CERTIFICATE OF CORRECTION

PATENT NO. : 4,864,792

DATED : September 12, 1989

INVENTOR(S) : Andre DeSchutter, et al.

It is certified that error appears in the above-identified patent and that said Letters Patent is hereby corrected as shown below:

On the Title Page: "Andre, et al." should read as --DeSchutter, et al.--;

Column 2, line 46: after "panel" add --13--;

Column 2, line 62: "outermmost" should read as --outermost--;

Column 3, line 18: "10, 26" should read as --10-26--;

Column 3, line 28: "Pl" should read as --PL--;

Column 3, line 37: "a" should read as --as--;

Column 5, line 4: "horizontally" should read as --horizontal--;

Column 5, line 37: after "elements 12" delete --(FIG. 8)--

Column 6, line 32: "an" should read as --on--;

Column 6, line 59: "so" should read as --is--;

Column 7, line 39: change the first occurrence of "one" to --a--;

Column 8, line 35: "arrangemet" should read as --arrangement--;

Column 8, line 59: after "space" add --71--;

Column 11, line 62: "netting" should read as --nettings--;

UNITED STATES PATENT AND TRADEMARK OFFICE

CERTIFICATE OF CORRECTION

PATENT NO. : 4,864,792

DATED : September 12, 1989

INVENTOR(S) : Andre DeSchutter, et al.

It is certified that error appears in the above-identified patent and that said Letters Patent is hereby corrected as shown below:

Column 12, line 31, Claim 7: "50" should read as --6--;

Column 13, line 21, Claim 9: before "second" add --a--;

Column 14, line 34, Claim 10: "frst" should read as --first--.

Signed and Sealed this

Twenty-fourth Day of September, 1991

*Attest:*

HARRY F. MANBECK, JR.

*Attesting Officer*

*Commissioner of Patents and Trademarks*